US006266849B1

(12) United States Patent
Petit et al.

(10) Patent No.: US 6,266,849 B1
(45) Date of Patent: Jul. 31, 2001

(54) HANDLE WITH ATTACHMENT ASSEMBLY AND METHOD

(76) Inventors: Clannie Petit, 237 Hayes Rd.; Donald E. Boggs, 326 Boggs Rd., both of Pickens, SC (US) 29671

( * ) Notice: Subject to any disclaimer, the term of this patent is extended or adjusted under 35 U.S.C. 154(b) by 0 days.

(21) Appl. No.: 09/337,436

(22) Filed: Jun. 21, 1999

(51) Int. Cl.[7] ..... B65D 25/28

(52) U.S. Cl. ..... 16/425; 294/34; 220/759; 220/760

(58) Field of Search ..... 16/425, 422; 294/34, 294/29, 33; 220/759, 760

(56) References Cited

U.S. PATENT DOCUMENTS 1,992,378 * 2/1935 Lewis ..... 220/760
2,010,317 * 8/1935 Olson ..... 294/34
2,262,339 * 11/1941 Shaffer ..... 220/760
2,426,682 * 9/1947 Hallstream ..... 294/34
2,559,190 * 7/1951 Hallstream ..... 294/34
2,613,860 * 10/1952 Hoffman ..... 294/34
2,786,707 * 3/1957 Campbell ..... 220/759
4,993,767 * 2/1991 Song ..... 294/34
5,042,676 * 8/1991 Gohlke ..... 220/759
5,054,638 * 10/1991 Rose ..... 220/94 R
6,102,458 * 8/2000 Scace ..... 294/34

* cited by examiner

*Primary Examiner*—Anthony Knight
*Assistant Examiner*—Mark Williams
(74) *Attorney, Agent, or Firm*—Flint & Kim, P.A.

(57) ABSTRACT

A handle with attachment assembly for use on a paint can (10) includes an elongated handle grip (A) which is horizontally positioned above the rim of an open paint can and is fastened by an attachment assembly which includes a clamp (B) for positioning a bracket (C) for carrying a pivotal mounting member (D) for spaced arms (E). The clamp is resiliently urged downwardly by a spring (F) carried by a lower clamp (G) for resilient connection on a lower rim of the paint can.

11 Claims, 4 Drawing Sheets

HANDLE WITH ATTACHMENT ASSEMBLY AND METHOD

BACKGROUND OF THE INVENTION

This invention relates to a handle with an attachment assembly and method which is especially useful on paint cans having an open top defined by a circular rim wherein a handle grip is positioned above the rim carrying the paint can suspended by gravity from the handle grip during painting.

One of the chief impediments to increased efficiency in painting stems from the fact that there is no handle available for convenient use by the painter. The typical handle consists of a wire bale which is pivotedly carried adjacent to the top of a paint can. The bale is pivoted on each end on opposite sides of the paint can and when held by the user during painting assumes a position overlying a central portion of the paint can. The bale cuts into the hand of the user after extended carrying of the paint cans requiring temporary placement in various places such as on the floor while resting the hand preparatory to further painting. Use of the bale is awkward especially when reaching overhead, on ladders and various forms of scaffolding causing wear and tear on the hands of the painter. The bale acts as an obstruction for ready access to the paint in the can because the wet paint brush must be inserted between the hand and the rim calling for care in insertion and removal of the brush so that the hand of the painter often receives some of the painting during the process.

The conventional handles are always in the way and hurt the hand of the user requiring frequent putting down of the can to rest the hand. Other positions for holding the can wherein the thumb is used to hold the bale with the fingers supporting the can in position to maximize accessibility to the can makes it inconvenient to use the thumb long in this fashion without excessive fatigue.

A number of efforts have been made to solve problems in supporting paint cans through alternative handle configurations. The prior art is represented by U.S. Pat. Nos. 5,145,226, Des 345,833, 5,482,339 and 5,511,753. The structures illustrated in these patents are believe to have been utilized with only limited success.

SUMMARY OF THE INVENTION

An important object of the invention is to provide an improved handle to increase production during painting particularly where a paint can with brush is utilized.

A very important object of the invention is to provide a handle for a paint can which is easy on the hand of the painter even after prolonged use.

The method of painting includes the steps of positioning a handle grip above the rim carrying a paint can in depending relation from the handle grip and being substantially freely suspended by gravity while being supported against turning with respect to the handle and the paint can during the process of painting.

Another important object of the invention is the provision of a handle which is horizontally positioned above and in general vertical alignment with an edge or rim of a paint can so that the can may be freely suspended by gravity with avoidance of twisting during painting so as to provide substantially unobstructed access to the paint can by a paint brush.

Another important object of the invention is to provide a handle for use on a paint can which is pivotally carried above an edge of the paint brush to suspend the can at an attitude wherein the open top of the paint can is tilted slightly downwardly with only limited obstruction to access during painting.

Another important object of the invention is the provision of an attachment assembly for connection to an object which may be generally cylindrical such as a paint can for positioning and accessibility supporting the object during its use such as in painting. The auxiliary handle and attachment assembly preferably includes a handle grip which is horizontally carried above a clamp for securement as to a paint can and the like. A pivotal mounting is provided for suitable connection of the handle through connecting arms to the clamp.

While the invention has been described in the context of use of the apparatus and method in connection with a paint can and brush during painting, it is evident that other uses may be found such as may facilitate the handling of cylindrical and other objects for better carrying out their function.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
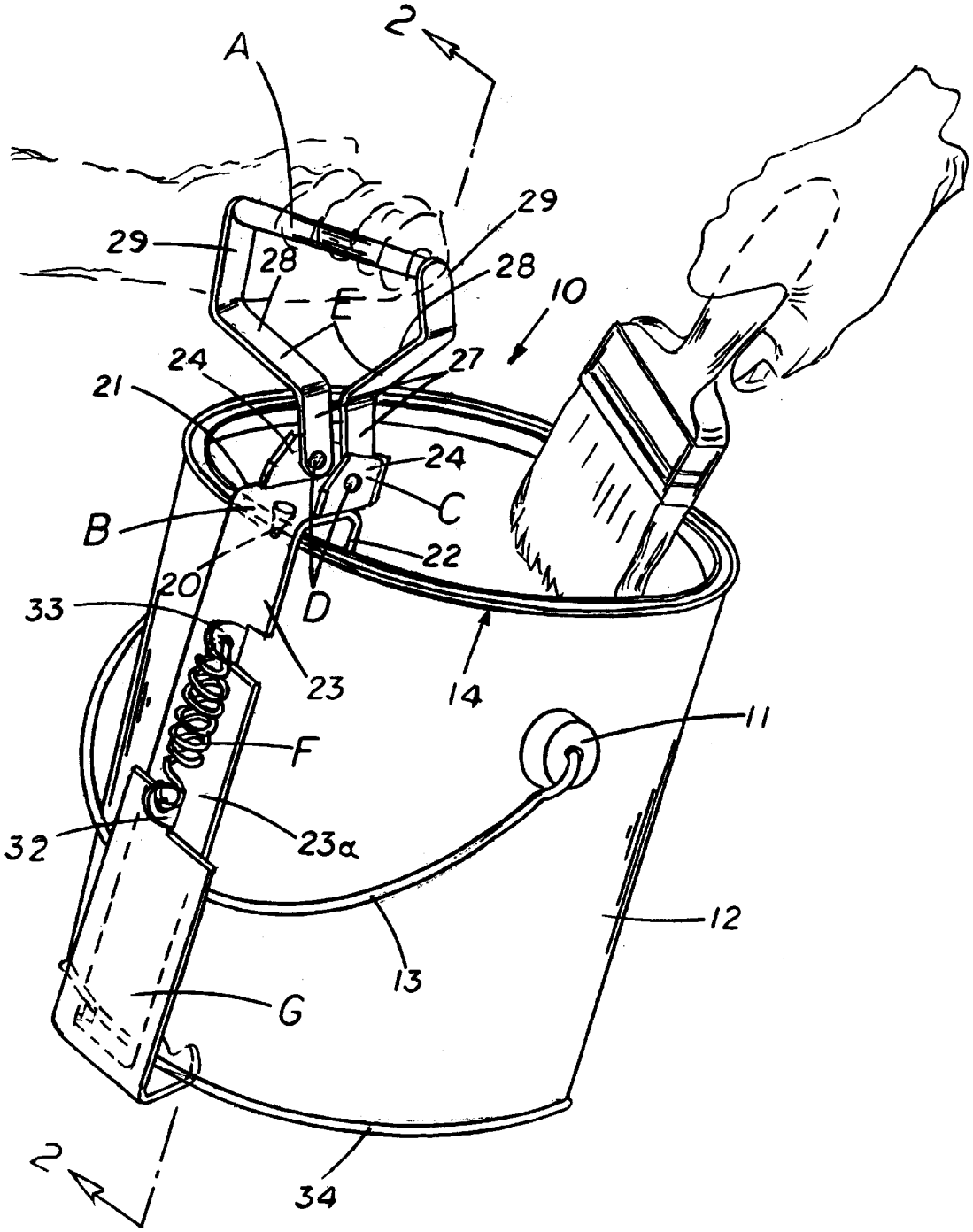
FIG. 1 is a perspective view of an auxiliary handle and attachment assembly constructed in accordance with the invention being utilized on a paint can during painting demonstrating the slightly forward tilt of the open top affording unobstructed access to the paint can with convenient support for the hand of the user.

An auxiliary handle and attachment for use on a paint can having an open top defined by a circular rim includes an elongated handle grip A receivable by a hand of a user during painting. A clamp B is secured to the paint can adjacent to the rim. A mounting connection including a bracket C is fixedly carried by or may be integral with the clamp. A pivotal mounting member D is carried by the mounting connection on a generally horizontal axis generally parallel to a tangent to the rim. A connector including spaced arms E is carried for pivotal movement by the pivotal mounting member on one end and by the handle grip on the other end. The method contemplates positioning a handle grip above the rim carrying a paint can in depending relation from the handle grip and freely suspended by gravity while being supported against turning in respect to the handle during painting.

Referring more particularly to the drawings, a paint can which may be of the conventional one gallon size and configuration is broadly designated as at 10. The paint can includes opposed side portions for carrying diametrically opposed pivotal mountings 11 on a cylindrical side surface 12. The conventional semi-circular bale 13 is pivoted at each end on opposite sides of the paint can 10 on the mountings 11. The paint can includes a conventional rim, broadly designated at 14 defining an open upper end. The rim 14 is provided with grooves best illustrated in FIG. 2 for receiving a paint can cover in sealing relation for use in shipping and resealing the paint can as when the contents are only partially used. The rim 14 includes a groove defined by an upright inner surface 15 having a depending inner lip 16. The groove further includes a wall 17 opposite the wall 15. A lesser groove 18 includes a vertical circumferential wall or rim 19. A portion of the rim 14 is often cut away by painters at the base of the surface 15 to facilitate the removal of excess paint from a brush and to avoid the accumulation of paint in the grooves during painting. For this reason, the clamp B includes a depending inner leg 20 in opposed relation to the vertical wall 17. The leg 20 may assume the configuration of a pin-like projection carried beneath a horizontal portion 21 of the generally U-shaped clamp B in addition to the leg defined by the projection 20. An inner downturned leg 22 is provided for imparting rigidity to the clamp while an opposite leg 23 extends downwardly providing a sliding portion 23*a* which is resilient urged downwardly to assure engagement of the clamp B adjacent the upper rim. A mounting connection includes a bracket C which is suitably secured as by welding on an upper surface on a horizontal clamp member 21. The bracket is generally U-shaped and has parallel legs 24 which are bridged by an intermediate member 25, FIG. 3. The member 25 may serve to limit movement of the handle in a clockwise direction substantially beyond the position shown in FIG. 2. The legs 24 form part of a pivotal mounting member D receiving complementary opposed stub shafts 26, FIG. 3. The stub shafts extend outwardly from a connector which is illustrated as including spaced arms E. The arms are each illustrated as including parallel mounting portions 27 which carry diverging portions 28 which terminate in parallel handle grip carrying members 29, FIG. 1. The handle grip A is generally parallel and is positioned at the ends of the arm members 29 and connected thereto as by welding or a rotatable connection, not shown, may be provided.

The positioning of the mounting member D and reception of the stub shafts 26 with respect to alignment with and above the rim 14 is a trade off between an excessive tilt which would occur if the mounting member D is too remote from the opening in the rim and excessive obstruction of the open top if the mounting member D is so far within the opening as to cause such obstruction. This is best illustrated in FIG. 2.

Figure 2:
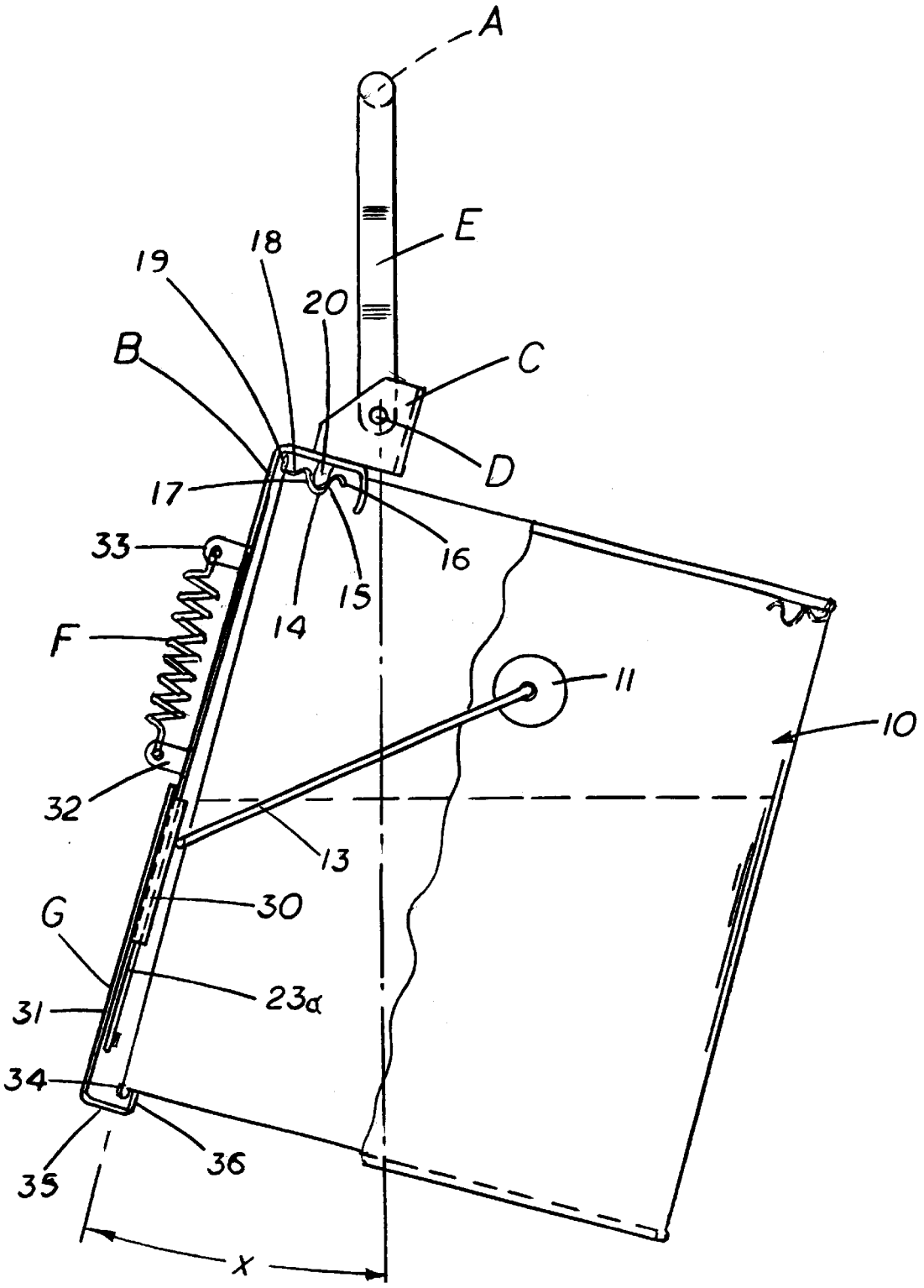
FIG. 2 is a side elevation taken along the line 2—2 in FIG. 1 illustrating use of the attachment assembly overlying the bale of a paint can with attachment of the handle with pivotal mounting for assuming a vertical position for supporting the paint can freely by gravity in a forwardly tilted position.
Figure 3:
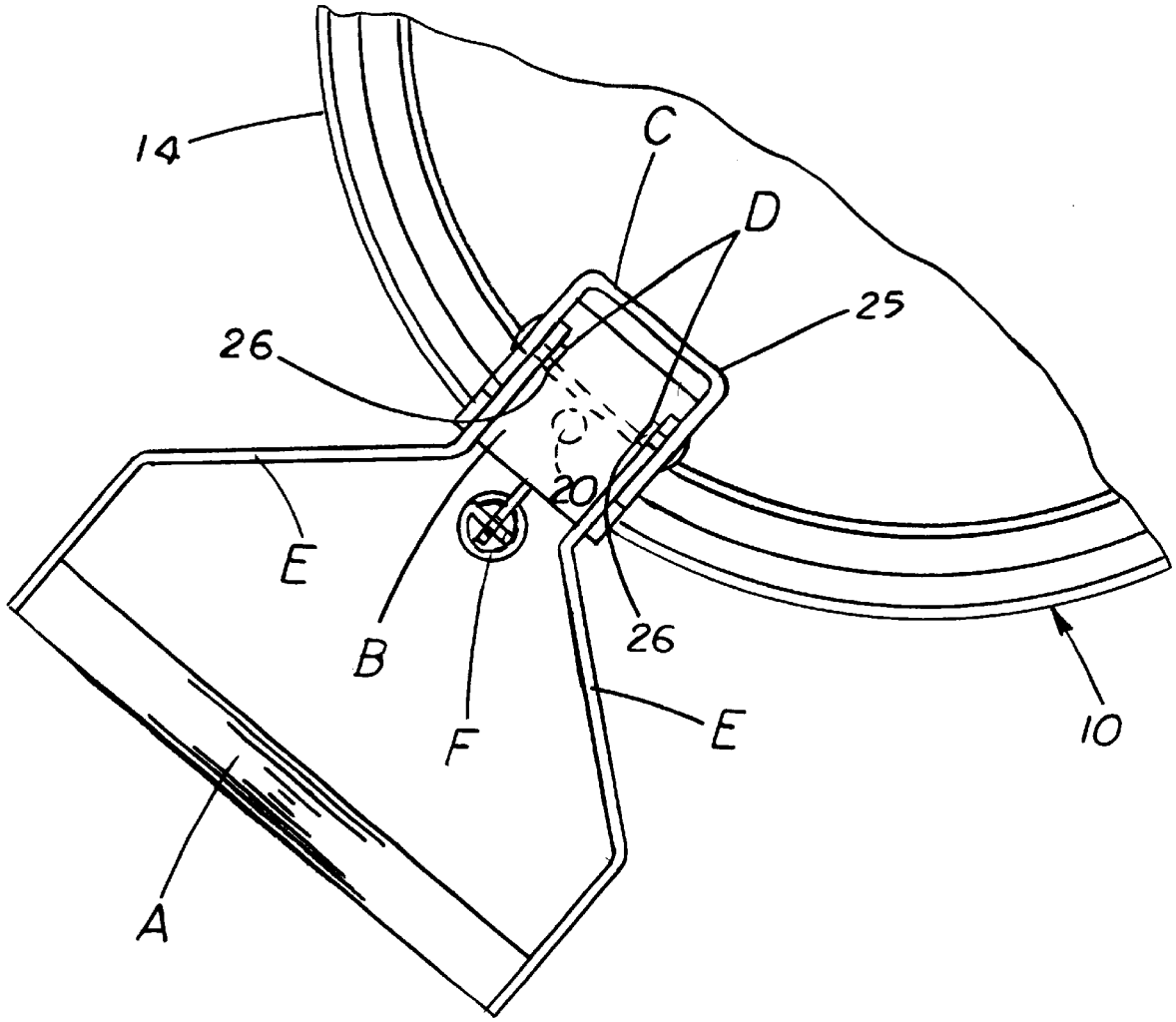
FIG. 3 is a top plan view with parts broken away illustrating the handle and its connection with respect to the paint can in a lowered position wherein a mounting bracket acts as a stop for limiting the movement of the handle below the generally horizontal position shown in FIG. 3, and wherein the upright position shown in FIG. 2 is defined by limited movement of the handle forwardly within the mounting bracket.
Figure 4:
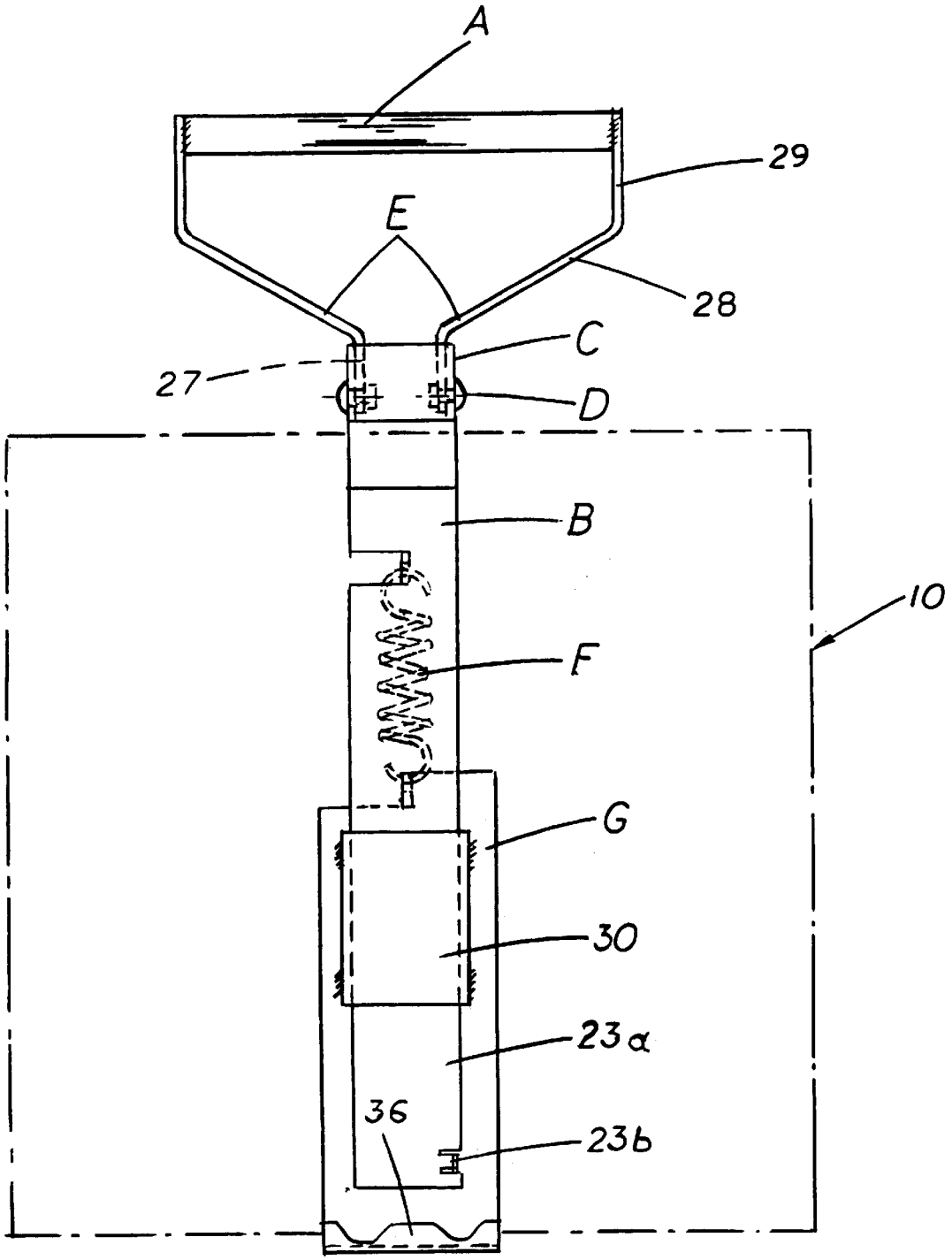
FIG. 4 is a rear elevation looking from the paint can side toward an inner face of the attachment assembly showing a second bracket which is vertically slidable upon the upper clamp for engaging a bottom of a can and which is preferably confined within a rim on a lower end of a can for exerting a resilient force to maintain the attachment assembly in position as upon a paint can for attachment of the handle above an upper rim.

Referring more particularly to FIGS. 1 and 2, an attachment assembly includes a second clamp member G which is slidably carried by a leg 23 of the first mentioned clamp B. The sliding connection is best illustrated in FIG. 2 wherein an elongated receptacle 30 which is open at both ends is provided for attachment to an outer leg 31 forming the sliding portion of the second clamp G. A sliding portion 23*a* of the leg is received within the vertical receptacle 30. A spring F is fastened on one end to a post 32 carried by the second clamp G on one end and top a post 33 on the leg 23 on the other end so that the spring acts as a tension spring positioning the attachment assembly between an upper rim 14 of the paint can and a lower rim illustrated at 34. The second or lower clamp G includes a horizontal connection 35 which carries an upwardly extending lip 36 for reception upon the lower rim 34 of the paint can.

While a preferred embodiment of the invention has been described using specific terms, such description is for illustrative purposes only, and it is to be understood that changes and variations may be made without departing from the spirit or scope of the following claims.

What is claimed is:

1. A handle for use on a paint can having an open top defined by a circular rim comprising:

an elongated handle grip receivable by a hand of a user during painting;

a clamp secured to the paint can adjacent to the rim, said clamp including a down turned leg extending into said open top;

a mounting connection carried by the clamp above the rim; and a connector carried by the mounting connection pivotally connecting the handle grip with the clamp above the rim for suspending the paint can therefrom with the open top in a properly tilted position;

whereby the paint can is carried in depending relation to the handle grip maintaining the open top accessible during painting.

2. The handle set forth in claim 1 wherein the clamp is removably secured to the rim.

3. The handle set forth in claim 1 wherein the mounting connection is a bracket fixedly carried by the clamp.

4. The handle set forth in claim 1 wherein the connector includes a pair of arms spaced at the other end for connection at respective ends of the handle grip and converging toward the one end for connection to the mounting connection, whereby the handle grip is maintained generally parallel to a tangent to the rim in a generally horizontal position above the rim during painting.

5. The handle set forth in claim 1 wherein the clamp is generally U-shaped having spaced legs for reception on the rim, and at least one spring removably urging the clamp into engagement on the rim during painting.

6. The handle set forth in claim 5 including a downward projection forming an inner leg for receiving an inner periphery of the rim.

7. A handle for attachment and use on a paint can having an open top defined by a circular rim comprising:

an elongated handle grip receivable within a hand of a user during painting;

a clamp removably secured to the paint can adjacent to the rim;

a mounting connection fixedly carried by the clamp above the rim;

a pivotal mounting member carried on the mounting connection above the rim and on a generally horizontal axis generally parallel to a tangent to the rim; and spaced mounting arms each carried for pivotal movement by the pivotal mounting member on one end and by the handle grip on the other and extending above the rim positioning the handle grip for suspending the paint can therefrom freely by gravity;

whereby the paint can is carried in depending relation without turning on a vertical axis in respect to the handle grip with the open top of the paint can in a properly tilted position during painting maintaining the open top accessible and substantially unobstructed during painting.

8. An attachment assembly for use on an object having a top and a bottom comprising:

a first clamp removably secured to the object adjacent to the top;

a second clamp removably secured to a bottom of the object;

a sliding connection between the first and second clamps; and at least one spring connected on one end to the first clamp and on the other end to the second clamp;

an elongated handle grip positionable on the first clamp generally horizontally above and in general alignment with a rim of the top for pivotally suspending the object from the hand of a user;

whereby the attachment assembly is removably secured to the object.

9. The attachment assembly set forth in claim 8 wherein the object is a paint can.

10. The method of carrying a paint can for maintaining a top of the paint can open for easy access during painting comprising the steps of:

suspending the paint can from a generally horizontal elongated handle grip;

positioning the handle grip during painting above and in general alignment with an upper rim of the paint can; and pivotally connecting the handle grip adjacent to the top of the paint can while avoiding relative twisting movement on an upright axis between the handle grip and the paint can;

whereby fatigue of the use is reduced increasing productivity in painting.

11. The method set forth in claim 10 including the step of pivotally mounting the handle grip to allow a downward tilt of the open top during painting to facilitate easy access.

* * * * *